US006168389B1

(12) United States Patent
Fukushima

(10) Patent No.: US 6,168,389 B1
(45) Date of Patent: Jan. 2, 2001

(54) SWASH PLATE TYPE COMPRESSOR IN WHICH IMPROVEMENT IS MADE ABOUT A SHOE INTERPOSED BETWEEN A SWASH PLATE AND A PISTON

(75) Inventor: Eiji Fukushima, Gunma (JP)

(73) Assignee: Sanden Corporation, Gunma (JP)

( * ) Notice: Under 35 U.S.C. 154(b), the term of this patent shall be extended for 0 days.

(21) Appl. No.: 09/200,799

(22) Filed: Nov. 27, 1998

(30) Foreign Application Priority Data

Nov. 28, 1997 (JP) ..... 9-327689

(51) Int. Cl.[7] ..... F04B 1/12
(52) U.S. Cl. ..... 417/269
(58) Field of Search ..... 417/269; 74/55, 74/56; 92/71

(56) References Cited

U.S. PATENT DOCUMENTS

| | | |
|---|---|---|
| 4,568,252 | 2/1986 | Hattori et al. . |
| 4,662,267 | 5/1987 | Kaku et al. . |
| 4,734,014 | 3/1988 | Ikeda et al. . |
| 4,752,191 | 6/1988 | Onomura et al. . |
| 4,781,539 | 11/1988 | Ikeda et al. . |
| 5,495,789 | 3/1996 | Ogura et al. . |

FOREIGN PATENT DOCUMENTS

| | | |
|---|---|---|
| 19830228 | 2/1999 | (DE) . |
| 49-965509 | 6/1974 | (JP) . |
| 56-138474 | 10/1981 | (JP) . |
| 61-135990 | 6/1986 | (JP) . |

*Primary Examiner*—Philip H. Leung
*Assistant Examiner*—Daniel Robinson
(74) *Attorney, Agent, or Firm*—Baker Botts L.L.P.

(57) ABSTRACT

In a swash plate type compressor in which a shoe (3) is placed between a swash plate (5) and a reciprocal piston (2), the shoe has a convex curved surface (32) having a specific portion extending along an oblate spheroid defined by a predetermined ellipse. The piston has a concave spherical surface (2*a*) adaptable to the convex curved surface. The specific portion has a ring-like contact portion which is in contact with the concave spherical surface around a minor axis of the predetermined ellipse to surround a portion spaced from the concave spherical surface. In addition, the shoe has a sliding surface (31) slidable along the swash plate.

4 Claims, 2 Drawing Sheets

SWASH PLATE TYPE COMPRESSOR IN WHICH IMPROVEMENT IS MADE ABOUT A SHOE INTERPOSED BETWEEN A SWASH PLATE AND A PISTON

BACKGROUND OF THE INVENTION

The present invention relates in general to a swash plate type compressor and more particularly to a so-called semi-spherical shoe which is provided between a swash plate of the swash plate type compressor and a piston for reciprocating a piston in response to a rotation of the swash plate, and also relates to a piston joint using the shoe.

The swash plate type compressor has a swash plate and a reciprocal piston coupled to the swash plate by means of a piston joint. The swash plate is interlocked with and rotated by a rotational shaft.

The piston joint has, for example, a combination of a socket coupled to the piston and a shoe interposed between the socket and the swash plate. The shoe has a generally flat sliding surface which slides along the swash plate and will be called hereinunder a flat surface. The shoe further has a convex curved surface located on the opposite side of the flat surface. The socket has a concave spherical surface which receives the convex curved surface. The piston joint of the type is disclosed in Japanese Unexamined Publication Nos. 61-135990, 49-65509 and 56-138474.

During operation of the compressor, the shoe exhibits a swinging movement such as a wobble motion and the like relative to the socket of the piston in response to a rotational movement of the swash plate. Accordingly, it is strongly envisaged to provide and maintain a suitable lubricity between the convex spherical surface of the shoe and the concave spherical surface of the socket.

For example, U.S. Pat. No. 4,734,014 teaches to provide a shoe and a socket so that a radius curvature of the convex curved surface of the shoe is smaller than the radius curvature of the concave spherical surface of the socket and an apex or top of the spherical surface is formed flat. This structure will be advantageous since it permits to provide an oil reservoir between the flat surface of the shoe and the concave spherical surface of the socket so that a desired lubricity is obtained. In this structure, the contacting position where the shoe contact the concave spherical surface of the socket is located adjacent to the position of the above-stated oil reservoir and, in other words, the shoe contact the concave spherical surface of the socket at the position of an angular portion which lies on the boundary between the spherical curved surface of the shoe and the flat surface.

In general, some clearances or gaps are provided between the concave spherical surface of the socket and the spherical curved surface of the shoe, and between the flat surface of the shoe and the swash plate and, therefore, these clearances provide, during the operation of the compressor, both a relative vibration in an axial direction of the compressor and a relative vibration in a direction perpendicular to the axial direction. As a consequence of these relative vibrations and the aforementioned swinging movement (or wobble motion), it is assumed that there occurs an unexpected, unusual state that the boundary portion of the shoe contacts the concave spherical surface of the socket at the limited position only which surrounds the oil reservoir and no other place.

If this unexpected state occurs, the reactive force of the compression by the reciprocal movement of the piston is locally integrated to the contacted position, or in other words concentrated on only a part of the contacted position, and therefore it is likely that the conventional shoe structure in which the angular portion contacts the concave spherical surface of the socket as described above results in deformations on the concave spherical surface of the socket, due to plastic deformation, plastic flow and wear. Consequently, the possibility of generation of the relative vibrations described above will be increased.

SUMMARY OF THE INVENTION

It is therefore an object of the present invention to provide an improved shoe for a swash plate type compressor, which permits an increased lubricity with less possibility of generation of deformations on a concave spherical surface which is for receiving the shoe.

It is another object of the present invention to provide a piston joint for the swash plate type compressor, to which the improved shoe is employed.

It is still another object of the present invention to provide an improved swash plate type compressor in which improvement is made about such a shoe.

Other objects of the present invention will become clear from the description proceeds.

A shoe to which the present invention is applicable is for a swash plate type compressor which comprises a swash plate rotatable on an axis and a reciprocal piston connected to the swash plate through the shoe and having a concave spherical surface at an end thereof, the shoe having a convex curved surface adaptable to the concave spherical surface of the piston. In the shoe, the convex curved surface has a cross sectional shape extending along a part of a predetermined ellipse.

A piston joint to which the present invention is applicable is for a swash plate type compressor which comprises a swash plate and a reciprocal piston, the piston joint comprising a socket connected to the piston and a shoe between the socket and the swash plate, the shoe having a sliding surface slidable along the swash plate and a convex curved surface opposite to the sliding surface, the socket having a concave spherical surface for receiving therein the convex curved surface of the shoe. In the piston joint, the convex curved surface has a specific portion extending along an oblate spheroid defined by a predetermined ellipse. The specific portion has a ring-like contact portion which is in contact with the concave spherical surface around a minor axis of the predetermined ellipse to surround a portion spaced from the concave spherical surface.

A swash plate type compressor to which the present invention is applicable comprises a swash plate rotatable on an axis, a reciprocal piston having a concave spherical surface at an end thereof, and a shoe interposed between the swash plate and the piston and having a convex curved surface adaptable to the concave spherical surface and a sliding surface slidable along the swash plate. In the swash plate type compressor, the convex curved surface has a specific portion extending along an oblate spheroid defined by a predetermined ellipse. The specific portion has a ring-like contact portion which is in contact with the concave spherical surface around a minor axis of the predetermined ellipse to surround a portion spaced from said concave spherical surface.

DESCRIPTION OF THE PREFERRED EMBODIMENT

Figure 1:
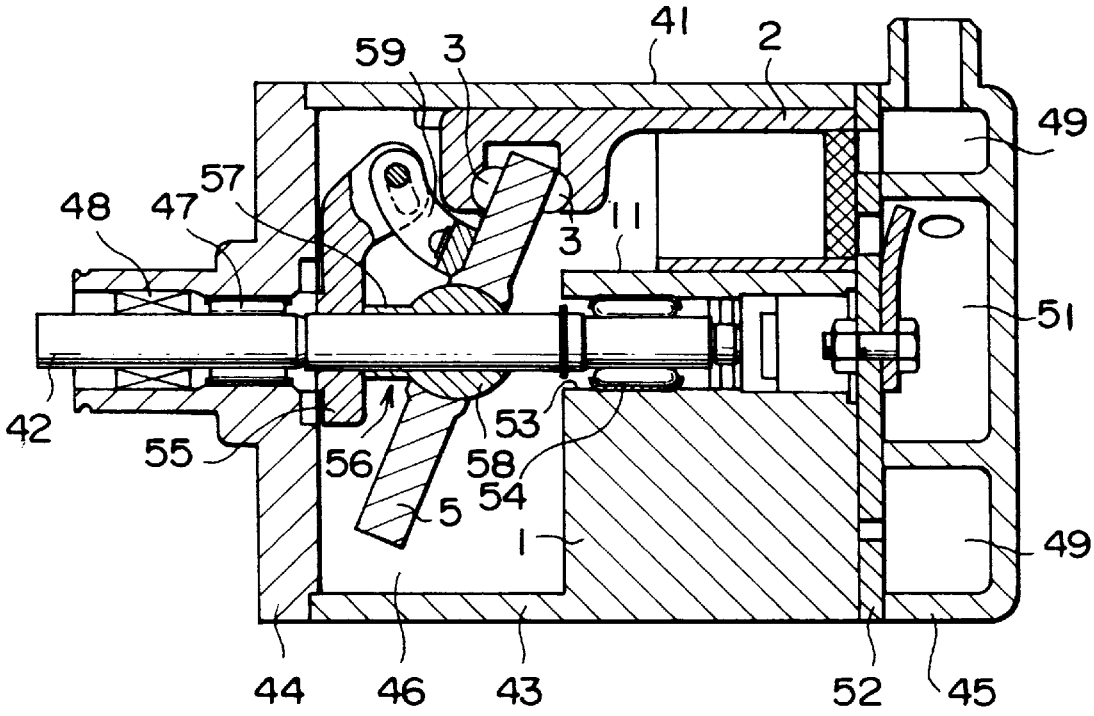
FIG. 1 is a longitudinal sectional view of a swash plate type compressor according to a preferred embodiment of the invention.

Referring to FIG. 1, description will be made as regards a swash plate type compressor according to a preferred embodiment of the invention.

The compressor comprises a casing 41, a cylinder block 1 having a plurality of cylinder bores 11, a rotary shaft 42, a swash plate 5, a plurality of single-head pistons 2, and a pair of shoes 3, which are assembled in the manner known in the art.

The casing 41 comprises a casing body 43, a front end plate 44, and a cylinder head 45. The casing body 43 is of a cylindrical shape and is integrally formed with the cylinder block 1. The front end plate 44 has a generally funnel-like shape and is attached to one open end of the casing body 43 to close the one open end. Thus, a crank chamber 46 is defined between the cylinder block 1 and the front end plate 44. The front end plate 44 has a shaft seal cavity in which a radial needle bearing 47 and a shaft seal member 48 are disposed. The cylinder head 45 has a suction chamber 49 and a discharge chamber 51 and is attached to the other end of the casing body 43 through a valve plate 52.

The cylinder block 1 has a center hole 53 and the cylinder bores 11 equiangularly spaced about an axis of the rotary shaft 42. The center hole 53 is formed in a portion of the cylinder block 1 at a center of the plurality of cylinder bores 11. Within the center hole 53, a radial needle bearing 54 is disposed. The cylinder bores 11 are formed in an outer peripheral zone of the cylinder block 1 at an equal interval in a circumferential direction to surround the center hole 53.

The rotary shaft 42 has one end portion rotatably supported by the front end plate 44 through the radial needle bearing 47 and the other end portion rotatably supported by the cylinder block 1 through the radial needle bearing 54. A top of the one end portion of the rotary shaft 42 protrudes through the front end plate 44 outward of the casing 41. A gap between the rotary shaft 42 and the front end plate 44 is sealed by the shaft seal member 48. On the rotary shaft 42, a rotor 55 and a swash-plate fitting member 56 are mounted. The rotor 55 is fixed to the rotary shaft 42 to be rotatable with the rotary shaft 42. The swash-plate fitting member 56 comprises a cylindrical member 57 and a spherical or ball portion 58 and is movable on the rotary shaft 42 in an axial direction of the rotary shaft 42.

The swash plate 5 has a disk shape and is rotatably attached on the ball portion 58 of the swash-plate fitting member 56. Furthermore, the swash plate 5 is coupled to the rotor 55 through an arm 59 swingably coupled to a top end portion of the rotor 55. With this structure, the swash plate 5 is rotated together with the rotary shaft 42 and can be varied in its inclination angle with respect to the axial direction. Thus, the compressing capacity of this compressor is variable dependent on the inclination angle.

Figure 2:
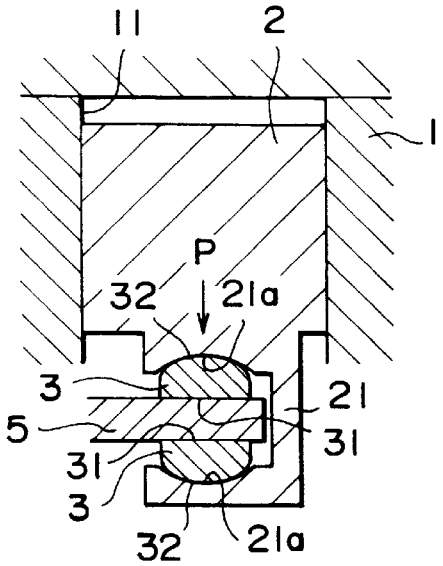
FIG. 2 is an explanatory diagram showing a main portion of the swash plate type compressor.

Referring to FIG. 2 in addition, the piston 2 is reciprocally and axially movable in the cylinder bore 11 and has at its axial end a socket 21 which is formed integral with the piston 2. The socket 21 has concave spherical surfaces 21*a* in a spaced confronting relation. The shoes 3 are disposed in the concave spherical surfaces 21*a* in a similar spaced confronting relation. A swash plate 5 which is rotated in cooperation with the operation of the rotary shaft 42 is provided between the paired shoes 3.

When the rotary shaft 42 is rotated, the swash plate 5 is driven to reciprocate the piston in the cylinder bore 11 through the shoes 3 and socket 21. This consequently provides repeated cyclical motions of suction, compression and discharge, in turn. For the simplification only, a combination of the shoes 3 and the socket 21 will be referred herein to a piston joint.

Each of the shoes 3 has a sliding surface or a flat surface 31 which slides on an end surface of the axial direction of the swash plate 5, a convex curved surface 32 on the opposite side of the flat surface 31, and a cylindrical surface 33 between the flat surface 31 and the convex curved surface 32. The convex curved surface 32 is inserted into or received in the concave spherical surface 21*a* of the socket 21.

Figure 3:
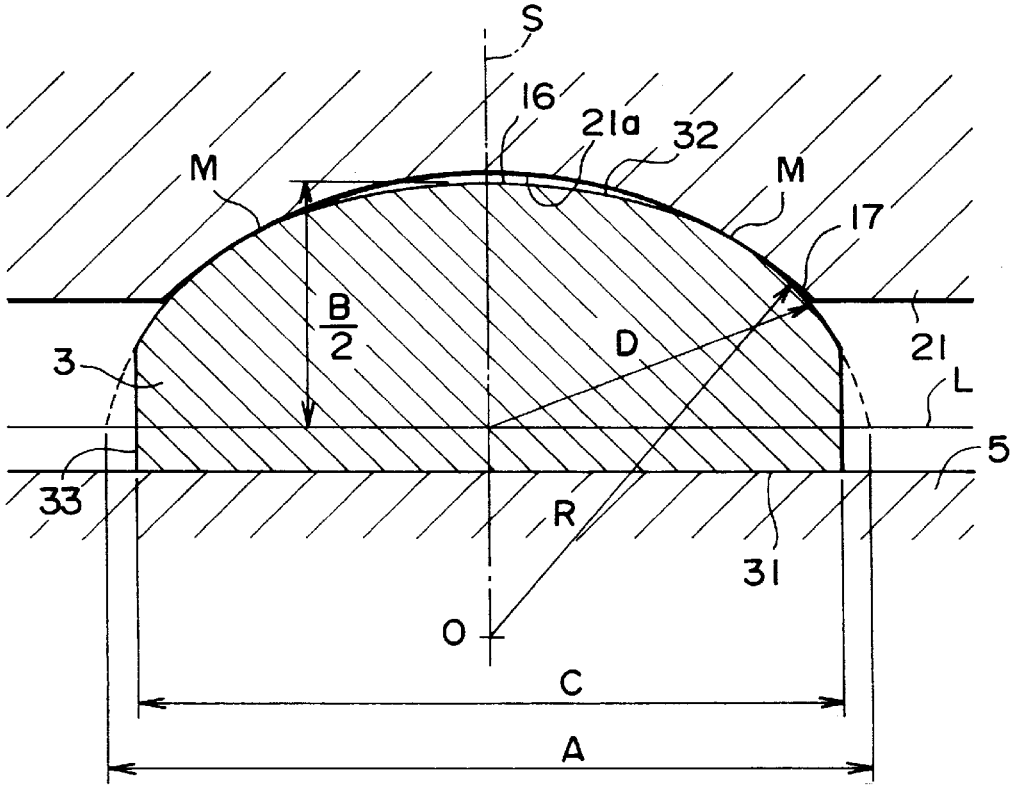
FIG. 3 is an enlarged diagram of a part of the main portion shown in FIG. 1.

Referring to FIG. 3 together with FIG. 2, the description will be made as regards a correlation between the concave spherical surface 21*a* and the convex curved surface 32 by the use of actual measurements of size of respective parts or portions.

First, the concave spherical surface 21*a* has a radius curvature (R) of 9.0 mm. On the other hand, the convex curved surface 32 has a basic structure based upon a predetermined ellipse having a longer or major axis L, and a shorter or minor axis S. More specifically, the convex curved surface 32 is formed in line with an ellipsoid of revolution or an oblate spheroid which is obtained by rotating the ellipse around its minor axis S. In this case, a whole of the convex curved surface 32 is referred to as a specific portion. The longer diameter A of the ellipse is 14.8 mm. The shorter diameter of the ellipse is 11.2 mm. Therefore, compression B/A of the ellipse is approximately 0.76.

In FIG. 3, the dimension D, that is, a distance from a center O of an ellipse to a portion which corresponds to a starting end of the concave spherical surface 21*a* of the socket 21, is approximately 6.89 mm. A diameter C of the cylindrical surface 33 of the shoe 3 is designed to have a dimension which is sufficiently larger than the diameter of the starting end of the concave spherical surface 21*a* of the socket 21.

According to the piston joint described above, the convex curved surface 32 extending long the rotated elliptical surface of the shoe 3 is inserted into the concave spherical surface 21*a* of the socket 21 and, accordingly, ring-like contact portions M are formed around the minor (shorter) axis S of the ellipse. In other words, at least the ring-like contact portions M and their circumferential or adjacent portions have a shape which extends long the surrounding portion of the minor axis S in the oblate spheroid. The ring-like contact portions M are press-fitted to the concave spherical surface 21*a* of the socket 21 by a compression reactive force P which is generated during operation of the swash plate type compressor.

Further, the inside portion of the each ring-like contact portion M is spaced from the concave spherical surface 21*a* of the socket 21. Namely, in the inside of the ring-like contact portion M, a portion which is spaced from the concave spherical surface 21*a* of the socket 21 is left or remained, and an oil reservoir 16 is formed between the thus remained portion and the concave spherical surface 21*a*. The portions which are outer than the ring-like contact portions M are positioned in a confronting relation with each other, with a wedge-like gap remained in the concave spherical surface 21*a* to thereby form an oil inlet 17 extending along the entire circumference.

As well known in the art, an inclination angle of a portion of the swash plate 5 which slides along the shoe 3 varies according to the rotation of the rotary shaft 42. In accordance with the variance of the inclination angle, the shoes 3 reciprocated or place into a swinging movement such as a wobble motion along the concave spherical surface of the socket 21. In this case, a lubricating oil contained in a fluid to be compressed is introduced into the oil reservoir 16 through the oil inlet 17 are accumulated in the oil reservoir 16 and, therefore, an excellent lubrication is obtained between the concave spherical surface 21*a* of the socket 21 and the convex curved surface of the shoe 3, particularly at the position of the ring-like contact portions M. In addition, the oil inlet 17 which is a wedge shaped gap facilitates an efficient supply of the lubricating oil into the oil reservoir.

Further, since the diameter C of the cylindrical surface 33 of the shoe 3 is designed to be sufficiently larger than the diameter of the starting ends of the concave spherical surface 21*a* of the socket 21, the ring-like contact portions M is not escaped or dropped from the concave spherical surface 21*a* of the socket 21 when the shoes 3 are in the swinging movement. In other words, the diameter of the ring-like contact portion M is determined so that a contact between the ring-like contact portions M and the concave spherical surface 21*a* is substantially maintained all the time during the operation of the swash plate type compressor.

In addition to the above, since the ring-like contact portions M which contact with the concave spherical surface 21*a* of the socket and their adjacent portions are designed to have a shape which extends along the rotated elliptical surface, there will be no fear of troubles and/or accidental results which were found in the conventional technique due to deformations by a plastic deformation, plastic flow, wearing, etc. caused by an unfavorable contact between the angular portion of the shoe 3 and the concave spherical surface 21*a* of the socket 21.

The swash plate type compressor can provide an increased, desired lubricity with less possibility of generation of deformations on the concave spherical surface of the socket and a joint for the swash plate compressor employing the inventive shoe structure.

While the present invention has thus far been described in connection with a single embodiment thereof, it will readily be possible for those skilled in the art to put this invention into practice in various other manners. For example, a flat portion and recessed portion may be provided inside the ring-like contact portions M of the shoe 3. It is a matter of course that the present invention can be applied to a fixed volume type compressor in which the swash plate is fixed at a predetermined angle relative to the main shaft and also to the other type of compressor in which the angle of the swash plate is set variable. The specific portion may extend to form a ring shape around the minor axis of the oblate spheroid. The specific portion may further extend inside the ring shape to form a circular surface along the oblate spheroid.

What is claimed is:

1. A swash plate type compressor comprising a rotational shaft, a swash plate rotatable on axis, a reciprocal piston having a concave spherical surface at an end thereof, and a shoe interposed between said swash plate and said piston and having a convex curved surface adaptable to said concave spherical surface and a sliding surface slidable along said swash plate, wherein said convex curved surface has a specific portion extending along an oblate spheroid defined by a predetermined ellipse, said specific portion having a ring-like contact portion which is in contact with said concave spherical surface around a minor axis of said predetermined ellipse to surround a portion spaced from said concave spherical surface.

2. A swash plate type compressor as claimed in claim 1, wherein said specific portion extends to form a ring shape around said minor axis of the oblate spheroid.

3. A swash plate type compressor as claimed in claim 2, wherein said specific portion further extends inside said ring shape to form a circular surface along said oblate spheroid.

4. A swash plate type compressor as claimed in claim 1, wherein said ring-like contact portion has a position determined so that said ring-like contact portion is maintained in contact with said concave spherical surface during operation of said compressor.

* * * * *